US006718887B1

(12) United States Patent
Cook, Sr.

(10) Patent No.: US 6,718,887 B1
(45) **Date of Patent: *Apr. 13, 2004**

(54) PALLET DIVIDER

(75) Inventor: Dennis G. Cook, Sr., Leo, IN (US)

(73) Assignee: Torque-Traction Technologies, Inc., Maumee, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/387,419

(22) Filed: Feb. 10, 1995

(51) Int. Cl.[7] ..... B65D 19/38
(52) U.S. Cl. ..... 108/53.3; 108/53.1
(58) Field of Search ..... 108/53.3, 53.1, 108/53.5, 55.3, 51.11

(56) References Cited

U.S. PATENT DOCUMENTS 2,957,601 A 10/1960 Novick
3,214,057 A 10/1965 Box
3,526,195 A * 9/1970 Maryonovich ..... 108/53.3 X
3,672,530 A 6/1972 Bridenstine et al.
3,680,495 A * 8/1972 Pike ..... 108/53.3
4,000,704 A * 1/1977 Griffin, Jr. ..... 108/55.3 X
4,042,127 A 8/1977 Brossia
4,183,491 A 1/1980 Sanders et al.
4,226,192 A * 10/1980 Myers ..... 108/53.1
4,263,855 A * 4/1981 Lawlor ..... 108/53.3
4,413,737 A * 11/1983 Wind ..... 108/53.3 X
5,011,011 A 4/1991 Kidd
5,205,410 A 4/1993 Kuipers et al.

* cited by examiner

*Primary Examiner*—Jose V. Chen
(74) *Attorney, Agent, or Firm*—Hahn Loeser & Parks LLP

(57) ABSTRACT

A divider for use in a stacking system for shipping of products in multiple layers in association with a pallet. The dividers are stackable and nestable with one another and with the pallet, and include a retaining wall to prevent movement of products off of an upper supporting surface thereof. The divider may be molded of a high-density, polymeric material to form a strong, rigid and durable divider which may be reused. As the dividers are nestable within one another and a pallet with which they are used, reshipping of multiple dividers for reuse is simplified.

8 Claims, 5 Drawing Sheets

PALLET DIVIDER

BACKGROUND OF THE INVENTION

This invention relates generally to a pallet divider which is placed between layers of a product stacked on a pallet, and more particularly to a divider which is stackable with other similar dividers or with pallets with which they are used.

Pallets are used for stacking of a variety of products to allow simplified movement of a bulk amount of such products by means of a forklift or like-lift truck, as well as effective transportation and shipment of products on the pallets. In many cases, a plurality of layers of the product are provided on a single pallet, with a divider used to separate the layers of products thereon. Conventionally, some type of divider is placed between layers of products, with such dividers typically being some type of wood divider or plastic sheet. Such dividers are simply placed on the top of a layer of product, and thereafter another layer of products may be placed on top of the divider. After a plurality of layers of product have been stacked in this fashion on a bottom pallet, the entire stacked assembly is generally banded to avoid shifting of the individual layers. Thereafter, the stacked layers of products on the pallet may be handled by a lift truck and shipped in a desired manner. Although such dividers do function to separate layers of product stacked on a pallet, known dividers made of wood have several significant drawbacks. For example, in the packaging and shipping environment, the handling of pallets and dividers exposes each of these components to significant wear and tear, requiring constant repairs, particularly to wood dividers which simply cannot withstand excessive use in handling. Further, dividers formed of wood sheets can be dangerous to the workers loading and stacking products on the pallets, due to splinters in handling of the dividers themselves, as well as exposure to nails or other fasteners used in association with the dividers.

Another significant problem encountered with known dividers is found in that such dividers are not designed to compliment the pallets with which they are used, nor to facilitate containing layers of stacked products on the pallet. Simple plywood type dividers which are presently used provide little, if any, stability to the stacked load during shipping and handling. It should also be recognized that the use of a plastic sheet or other flexible type material as a divider would not provide any stability to the load, and is more easily torn and damaged than even a wood divider. Further, upon unloading of a pallet at the shipping destination, the plywood or plastic sheet dividers which have been used are considered disposable, and are therefore not reused, but simply replaced. This in turn creates a problem of waste disposal for the shipper, with the materials generally used for such dividers not being readily recyclable, such that the shipper would in fact incur costs in disposing of such dividers. Although the shipper may attempt to avoid the problem of disposal by attempting to reuse such dividers, handling of the dividers subsequent to unloading of a pallet is problematic in that the dividers are not compatible with one another or with the pallet with which they are shipped. The incompatibility of the dividers and pallet make handling subsequent to unloading of the pallet problematic, in that the dividers are not easily stacked for reshipment and reuse by the shipper.

Also with pallets loaded with a plurality of layers of product using dividers between the layers requires banding of the assembly once the plurality of layers are stacked on the pallet to allow subsequent handling of the assembly. Such banding is generally performed by wrapping metal bands about the periphery of the pallet and dividers in order to secure the assembly together. The metal bands used in the process are therefore exposed at the outer edge of the stacked pallet, and are prone to displacement from their securing position, or potentially to be caught by the fork of a fork truck or the like which could cause breaking of the banding and disruption of the stacked load.

SUMMARY OF THE INVENTION

Based upon the foregoing, it is a main object of the invention to provide a divider for use with a pallet to stack a plurality of layers of product on the pallet, with the dividers being compatible with the pallet and one another to allow nesting and stacking of the dividers with one another and also with a pallet with which they are used.

The invention is therefore directed to a divider for use in a stacking system for shipping of a product in multiple layers on a pallet comprising a bottom wall having an upper supporting surface on which a product or products is supported. The bottom wall has about at least a portion of its periphery an upwardly extending retaining wall to prevent movement of the products off of the upper supporting surface. The bottom wall further has a lower surface with a downwardly extending foot portion provided at least intermittently adjacent the periphery of the lower surface at a position inboard of the edge of the lower surface. The downwardly extending foot portion allows the divider to be nested within another like divider when stacked together. In the preferred form, the divider is molded of a high density polymeric material, forming a strong, rigid, and durable divider which may be reused with its design allowing easy reshipping of multiple dividers for such reuse. The divider in the preferred embodiment further includes a plurality of openings specifically adapted to allow simplified and more effective banding arrangements for securing multiple layers of products on a pallet using a number of dividers.

BRIEF DESCRIPTION OF THE DRAWINGS

These and other objects and advantages of the invention will become apparent upon a further reading of the detailed description of preferred embodiments, in conjunction with the drawings, wherein.

DETAILED DESCRIPTION OF THE INVENTION

Figure 1:
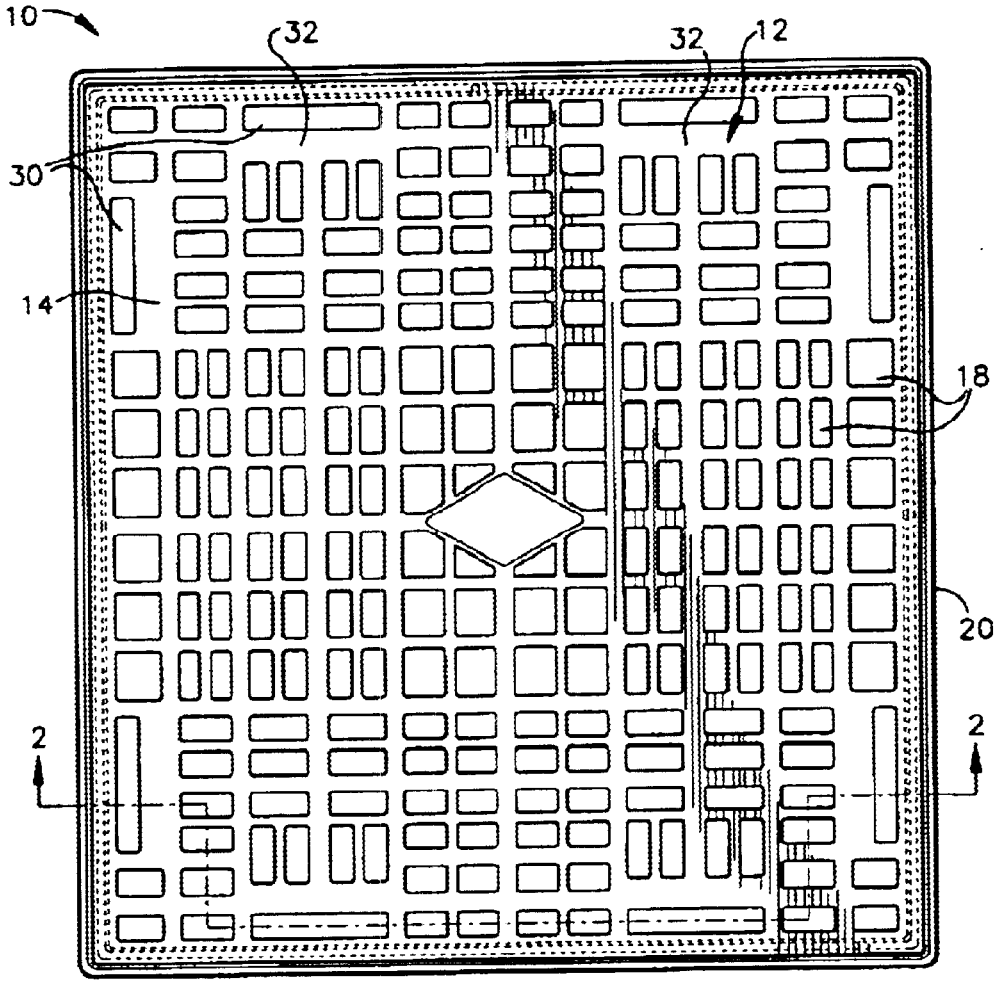
FIGS. 1 is a top elevational view of a preferred embodiment of a divider in accordance with the invention.
Figure 2:
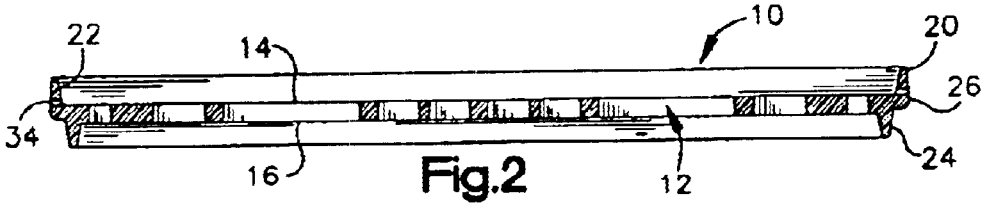
FIG. 2 is a crosstional view of the divider shown in FIG. 1 taken along line 2—2 in FIG. 1.

Turning now to FIGS. 1 and 2, a divider 10 according to the invention includes a bottom wall 12 having an upper supporting surface 14 on which products may be supported for transport in association with a pallet in a stacking system for shipping of a product in multiple layers on the pallet. The bottom wall 12 further includes a lower surface 16, and preferably a plurality of holes or apertures 18 formed therein. The holes 18 allow dirt or other debris to fall through the bottom wall 12 so as not to be accumulated thereon, and also facilitate washing of the divider 10 by simply spraying off the surfaces thereof with the water escaping through holes 18. Associated with the bottom wall 12 about at least a portion of its periphery is an upwardly extending retaining wall 20, which prevents movement of products off of the upper supporting surface 14 to provide increased stability in the stacking system. The upwardly extending retaining wall 20 may have an inner surface 22 which tapers outwardly, to facilitate nesting and stacking of the divider with other like dividers, as will be hereinafter described in more detail. Also associated with the lower surface 16 of bottom wall 12 is a downwardly extending foot portion 24 which is provided at least intermittently adjacent the periphery of the lower surface 16 at a position inboard of the edge 26 of the lower surface 16. The downwardly extending foot portion 24 allows the divider 10 to be nested within another like divider when stacked together, or in association with a pallet with which the divider 10 is used in the stacking system. In the preferred embodiment, the divider 10 is formed of a foamed, high density polyurethane or other polymeric material, which is molded into the desired configuration to form a rigid, highly durable divider construction. Divider 10 formed of this or a similar material avoids the problems associated with wood dividers, in that the divider 10 can withstand significant wear and tear normally encountered in handling of the dividers in loading of a pallet with a number of product layers using the dividers, and subsequent thereof, along with transporting and shipping of the stacking system. The divider 10 further does not pose any dangerous condition for the packaging and shipping personnel.

Also in the preferred embodiment of the divider 10 according to the invention, a plurality of the apertures are provided as banding slots 30, formed in the bottom wall 12 of the divider 10. The banding slots 30 are specifically formed adjacent to a reinforced area 32 in which no holes are formed, to provide greater strength in the bottom wall 12 in these regions. The banding slots 30 are designed to allow a plurality of stacked dividers to be secured together along with the pallet to secure the entire stacking system for subsequent transportation and shipment by means of a fork truck or similar heavy equipment. It should be recognized that when a plurality of dividers 10 are used to stack a number or layers of product on a pallet, that the banding slots 30 will be aligned with one another to allow the banding to be conveniently secured between the plurality of dividers. As also seen in FIG. 2, the upwardly extending retaining wall 20 may also be provided with a plurality of banding slots 34 which extend through the retaining wall adjacent the upper supporting surface 14 of the bottom wall 12. As will be hereinafter described in more detail, the banding slots 34 allow for convenient banding of a plurality of dividers in association with a pallet subsequent to unloading of a stacking system, with the plurality of dividers nested and stacked with one another.

Figure 3:
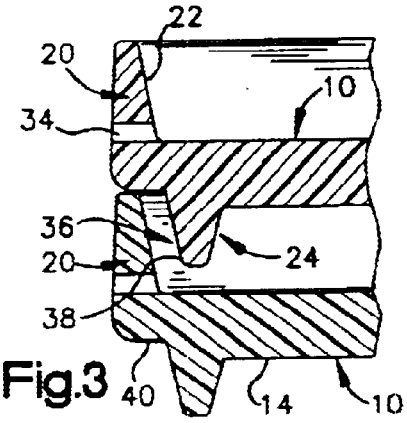
FIG. 3 is a partial cross-sectional view of two dividers in accordance with the invention nested and stacked with one another.

Turning to FIG. 3, the nesting and stacking of dividers 10 relative to one another are shown in partial cross-section. As the dividers 10 may have significant dimensions corresponding to the size of pallet they are used with, the preferred embodiment of the dividers 10 includes an upwardly extending retaining wall 20 having a predetermined height to facilitate nesting with other like dividers. As previously mentioned, the interior surface 22 of retaining wall 20 is preferably tapered outwardly, which facilitates nesting between stacked dividers. The downwardly extending foot portion 24 is positioned inboard of the edge of the bottom wall 12, such that a space 36 is provided between an upwardly extending retaining wall of an adjacent divider 10 when the dividers are nested and stacked with one another. The downwardly extending foot portion 24 will also preferably include an exterior wall 38 which tapers inwardly and matches the taper provided on the interior surface 22 of the adjacent retaining wall 20. Also in the preferred embodiment, the lower surface 14 of the bottom wall 12 is stepped up at the peripheral edge portion 40 between the foot portion 24 and the edge thereof. In this construction, the nesting relationship between adjacent dividers allows the dividers to locate in a generally centered manner relative to one another, with the space 36 provided between a foot portion 24 and an adjacent retaining wall 20 allowing an amount of lateral motion between the dividers to facilitate stacking and nesting in this manner. In the nested relationship, the opposing retaining walls 20 and foot portions 24 positively prevent slipping of stacked dividers relative to one another to enhance shipping and handling thereof for subsequent reuse.

Figure 4:
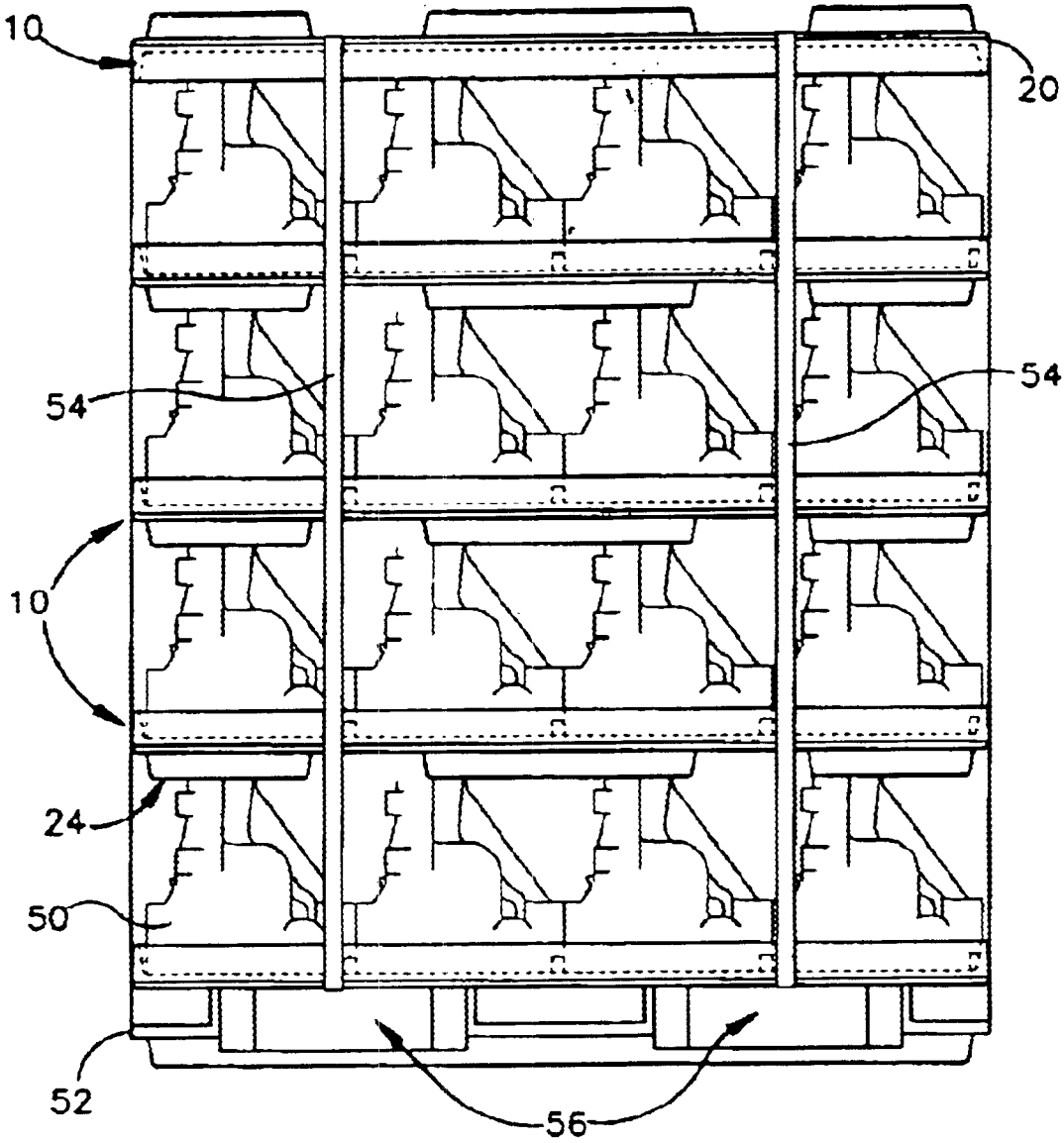
FIG. 4 is a side elevation view of a pallet having a plurality of layers of product stacked thereon, with a plurality of dividers used in association therewith.

A stacking system utilizing the dividers 10 of the invention is shown in FIG. 4, wherein a plurality of layers of a product 50 are stacked relative to one another on a base pallet 52. A first layer of products 50 are positioned directly on the pallet 52, and thereafter a divider 10 may be positioned on the top of the product layer, with the bottom surface 14 supported by the products 50 themselves or by other suitable supporting structures associated with the pallet 52. For proper stacking relationship between the layers of products, the divider 10 should be positioned substantially horizontal and parallel to the bottom pallet 52, to thus position the upper supporting surface 12 for accepting another layer of product 50 thereon. A plurality of such layers may then be stacked on the pallet 52 in this manner as shown in FIG. 4. In the stacked configuration, the entire arrangement of layers of product 50 in association with dividers 10 are then banded together by metal straps 54 or other suitable means. The banding 54 may be strung through the pair of fork openings 56 normally provided in the pallet 52 corresponding to the transportation of the pallet by a fork truck or similar heavy equipment. Once strung through the openings 56, the bands 54 may be strapped around the exterior of each of the dividers 10 as shown in FIG. 4. In a stacking system as shown in FIG. 4, the divider 10 of the invention also can provide a top or cover member, wherein the divider 10 is flipped upside down to form a cap on the entire stacking system. Using the divider 10 as a cap facilitates protecting products stacked on the top layer of the system, and also provides a structural member at the top of the assembly to facilitate banding of the entire stacked assembly together. In the embodiment of the dividers 10 shown in FIG. 4, the downwardly extending foot portion 24 is formed intermittently about the periphery of the bottom surface, and more particularly with corner sections and intermittent sections along each edge of the dividers. For the top cap of the stacking system, the divider 10 is flipped upside down, such that the upper supporting surface rests upon the top layer of product or other structural support members, with the retaining wall 20 is now extending downwardly to retain the products 50 therein. In this embodiment, the banding 54 may then be wrapped around the top cap divider 10, and around the entire stacked assembly and secured to itself to maintain the entire stacked assembly in a unitary configuration. In this configuration, the stacked assembly can be easily transported via fork truck or the like and loaded for shipping, with the plurality of layers of stacked products being maintained together in the loaded and banded pallet.

Figure 5:
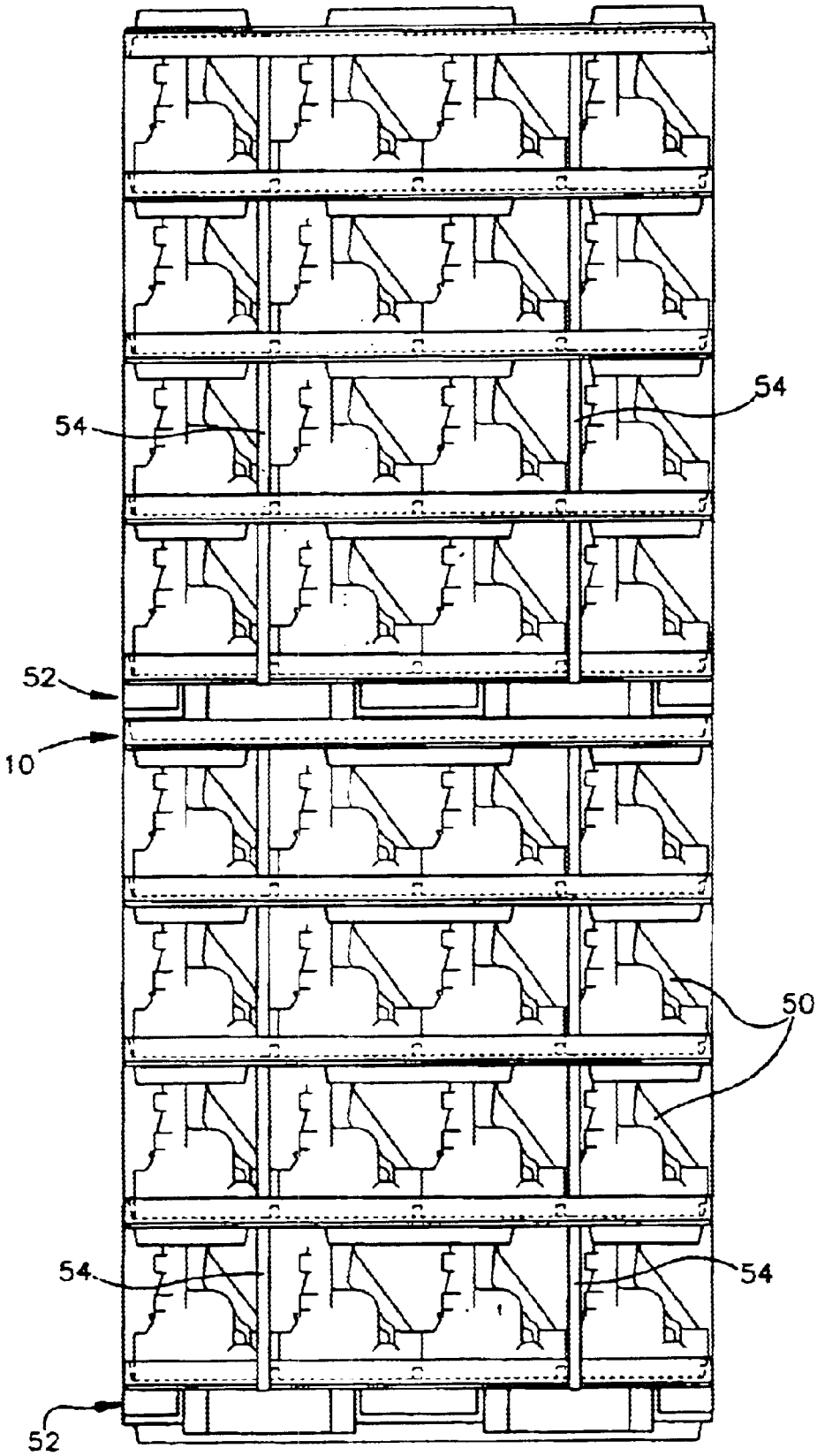
FIG. 5 is a side elevation view of a pair or stacked pallets, each having a plurality of layers of product stacked thereon, and having a plurality of dividers used to divide layers of product, and to allow double stacking of the pallet systems.

As another alterative encountered in many situations in shipping and transporting products, a plurality of stacked pallets similar to that shown in FIG. 4 are stacked with one another for efficient shipping of product. This arrangement is shown in FIG. 5, wherein again the dividers according to the invention facilitate stacking of individually banded stacked pallets with one another. If a plurality of stacked pallets are to be arranged in a stacked configuration as shown in FIG. 5, the divider 10 according to the invention is also desired to be configured to be compatible with the pallet to allow stacking of the pallet on the top divider used with an individual stacked pallet, such as that shown in FIG. 4. In a first embodiment, the divider 10 is designed to mate with the bottom portion of the pallet 52 by means of the upwardly extending retaining wall 20 so that the pallet 52 is nested within the divider 10 used at the top of a loaded pallet 52 with a plurality of layers of product capped by a divider 10. In the embodiment shown in FIG. 5, banding of the pallets 52 along with the plurality of dividers 10 in the individual loaded pallets is performed by running the metal straps 54 through the fork holes 56 and upwardly to then be strung through each of the dividers 10 for retaining the entire stacked assembly as a unit. In this embodiment, the metal straps 54 or the like are threaded through the banding slots 30 as described with reference to FIGS. 1 and 2. The metal straps 54 are therefore threaded interior to the edge of the dividers 10 so as not to be exposed on the outside of the stacked assembly. In this manner, the possibility of a fork truck or other piece of equipment catching a metal strap 54 during handling of the loaded pallets 52 is minimized, which could cause breaking of the straps 54 or cause the stacked assembly to fall, potentially damaging the product loaded thereon. In the divider 10 used as the top cap of the stacked assembly, the straps 54 may be threaded through the banding slot so as to run along the upper supporting surface 14 of the top divider 10. In this manner, the strap 54 would not impede nesting of the pallet 52 therein when a further stacked assembly is loaded on the top thereof as shown in FIG. 5. The position of the banding slots 30 (see FIGS. 1 and 2) also do not affect positioning of the product 50 on the dividers 10.

Figure 6:
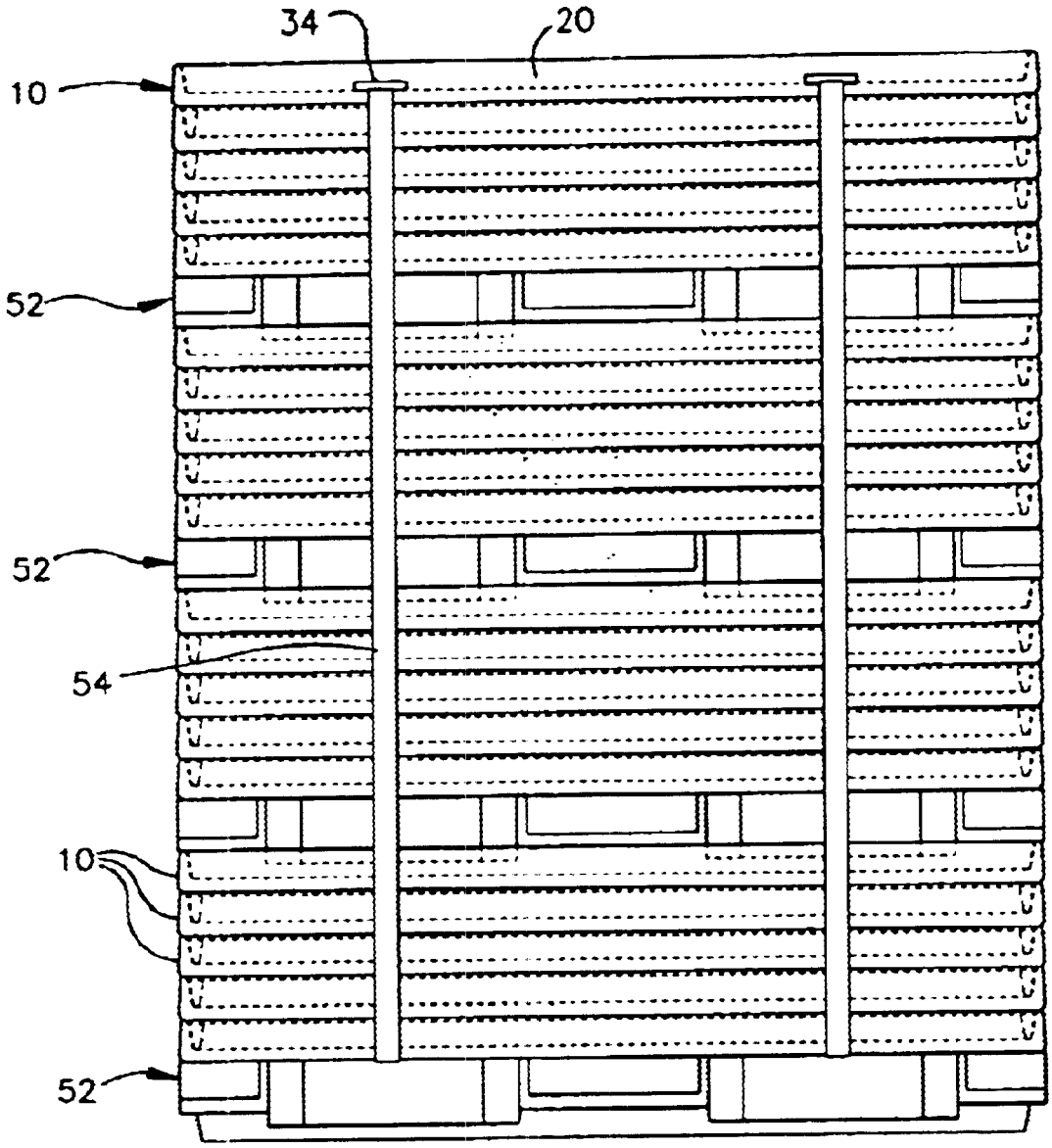
FIG. 6 is a side elevation view of a number of pallets nested and stacked with a plurality of divider subsequent to unloading of product therefrom, and ready for reshipment or reuse.

It should be recognized that the dividers 10 of the invention facilitate stacking of a plurality of layers of product in association with a pallet 52, and also because of their construction can be reused by the shipper. The facilitate reuse of the dividers 10 in association with the pallets 52, the dividers are designed to nest and stack with one another along with the pallets 52 with which they are used as shown in FIG. 6. The nesting relationship of each of the dividers 10 in association with one another and with the pallet 52 with which they are used allows a large number of dividers and pallets to be stacked with one another for simplified and efficient handling subsequent to unloading of the loaded pallets such as shown in FIGS. 4 and 5. As an example, four (4) pallets loaded such as shown in FIG. 4 may subsequently be combined after unloading into the configuration shown in FIG. 6 for easy shipping of the entire assembly back for reuse of the pallets 52 and dividers 10. In the nested and stacked configuration shown in FIG. 6, the entire assembly can be banded together to facilitate handling, with metal straps 54 or the like again passed through the fork holes 56 of the lowermost pallet 52 and on the exterior of the stacked assembly to be threaded through the banding slots 34 provided in the upwardly extending retaining wall 20 of the uppermost divider 10. In this manner, the bands or straps 54 will again lie flush along the top surface 14 of the bottom wall 12 of the uppermost divider 10 to allow subsequent stacking of a further stacked assembly such as that shown in FIG. 6 on the top thereof.

Figure 7:
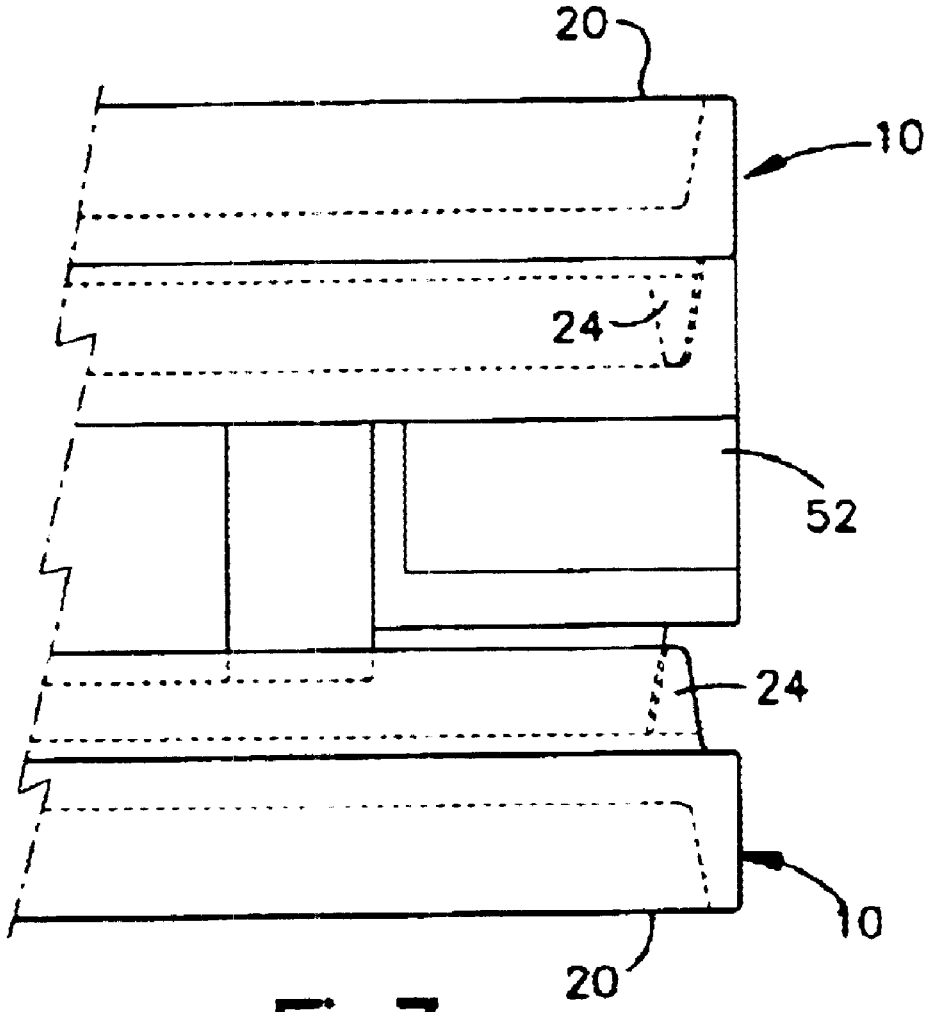
FIG. 7 shows an enlaraged partial side elevation view of a pallet in the nesting and stacking relationship with dividers in an alternate embodiment.

In an alternate embodiment of the dividers as shown in FIG. 7, the dividers 10 may be configured to be compatible with a pallet 52 in another way to facilitate stacking of two or perhaps more loaded pallets on top of one another. A plurality of layers of product may be loaded on the pallet 52 in the manner similar to that previously described, with the top layer of product capped by a divider 10 which is turned upside down such that the foot portion 24 extends upwardly as shown in the bottom divider 10 of FIG. 7. The foot portion of this cap divider 10 is configured to accept the bottom of a pallet 52 in a nesting relationship, to allow a further loaded pallet to be positioned on the top cap divider 10 in a positive manner. In this embodiment, a divider 10 having the downwardly extending foot portion 24 similar to that previously described is configured to nest within an upwardly opening cavity of the pallet 52. Subsequent to unloading of the stacked pallets, the nesting relationship between the pallets 52 and dividers 10 again allows them to be stacked and nested with one another to facilitate transportation back for reuse.

It should be recognized that the invention provides a divider for use with a pallet to allow multiple layers of products to be more effectively stacked on the pallet as the dividers are designed to compliment one another and the pallet with which they are used. The dividers 10 of the invention facilitate containing the multiple layers of the stacked products, and provide stability to the stacked load during shipping and handling. The dividers 10 are strong and durable, and therefore can be used a large number of times without any degradation, and even if damaged, are preferably made of a recyclable material. The dividers 10 facilitate banding of the stacked layers on a pallet, and enable two or more stacked and loaded pallets to be stacked upon one another for efficient shipping. Although the invention has been described with reference to preferred embodiments thereof, it should be recognized that various modifications or changes may be made without departing from the spirit and scope of the invention as defined in the appended claims.

What is claimed is:

1. A divider for use in a stacking, system for shipping of a product in multiple layers on a pallet comprising:

a bottom wall having an upper supporting surface on which at least one product is supported, said bottom wall having about at least a portion of its periphery an upwardly extending retaining wall to prevent movement of said at least one product off of said upper supporting surface, said bottom wall further having a lower surface with a downwardly extending foot portion provided at least intermittently adjacent to the periphery of said lower surface at a position inboard of the edge of said lower surface, wherein said downwardly extending foot portion is positioned at a predetermined distance inboard of said edge to allow said divider to be nested within another like divider when stacked together and wherein said downwardly extending foot portion is spaced from an interior surface of an upwardly extending retaining wall of said like divider with which it is stacked such that said upwardly extending retaining wall of said like divider supports the exterior portion of said bottom wall when nested.

2. The divider as recited in claim 1, wherein, said upwardly extending retaining wall has an interior surface which tapers outwardly from said upper supporting surface.

3. The divider as recited in claim 1, wherein, said bottom wall includes a plurality of holes therein through which dirt and debris may pass.

4. The divider as recited in claim 1, wherein, said upwardly extending retaining wall is continuous about the periphery of said bottom wall and includes a plurality of banding slots formed therein at a position adjacent to the upper supporting surface thereof.

5. The divider as recited in claim 1, wherein, said downwardly extending foot portion includes an exterior surface which tapers inwardly from said lower surface of said bottom wall.

6. The divider as recited in claim 1, wherein, said divider can be turned upside down to form the top cap member on a top layer of product loaded on a pallet.

7. The divider as recited in claim 1, wherein, said divider is formed of a foamed, high-density polyurethane material.

8. The divider as recited in claim 1, wherein, said bottom wall has said upwardly extending retaining wall positioned on at least two opposing sides thereof, said upwardly extending retaining wall including banding slots through which banding may be threaded to retain said divider in association with the pallet with which it is used.

* * * * *

UNITED STATES PATENT AND TRADEMARK OFFICE

CERTIFICATE OF CORRECTION

PATENT NO. : 6,718,887 B1
DATED : April 13, 2004
INVENTOR(S) : Dennis G. Cook

It is certified that error appears in the above-identified patent and that said Letters Patent is hereby corrected as shown below:

Column 6,
Line 58, replace “its periphery” with -- a periphery thereof --.
Line 65, replace “the” with -- an --.

Column 7,
Line 6, replace “the” with -- an --.

Signed and Sealed this

Twenty-first Day of December, 2004

JON W. DUDAS
*Director of the United States Patent and Trademark Office*